United States Patent [19]

Storandt

[11] 4,322,091

[45] Mar. 30, 1982

[54] CROSS COUNTRY SKI BINDING

[75] Inventor: Ralf Storandt, Leonberg, Fed. Rep. of Germany

[73] Assignee: Vereinigte Baubeschlagfabriken Gretsch & Co. GmbH, Leonberg, Fed. Rep. of Germany

[21] Appl. No.: 10,966

[22] Filed: Feb. 9, 1979

[30] Foreign Application Priority Data

Feb. 22, 1978 [DE] Fed. Rep. of Germany ..... 2807592

[51] Int. Cl.[3] ..... A63C 9/18

[52] U.S. Cl. ..... 280/615

[58] Field of Search ..... 280/615, 614, 623, 635, 280/611

[56] References Cited

U.S. PATENT DOCUMENTS

| | | | |
|---|---|---|---|
| 2,559,020 | 7/1951 | Lehmkuhl | 280/615 |
| 2,590,424 | 3/1952 | Lemkuhl | 280/614 |
| 3,386,748 | 6/1968 | Eie | 280/615 |
| 3,481,618 | 12/1969 | With | 280/615 |
| 3,907,319 | 9/1975 | Berlied, Jr. | 280/615 |
| 4,108,467 | 8/1978 | Kreyenbuhl | 280/615 |

FOREIGN PATENT DOCUMENTS

| | | | |
|---|---|---|---|
| 289361 | 2/1915 | Fed. Rep. of Germany | 280/615 |
| 819961 | 2/1949 | Fed. Rep. of Germany . | |
| 1603004 | 6/1974 | Fed. Rep. of Germany . | |
| 2504304 | 8/1975 | Fed. Rep. of Germany | 280/615 |
| 2633373 | 2/1978 | Fed. Rep. of Germany | 280/615 |
| 107796 | 4/1966 | Norway . | |
| 125874 | 11/1972 | Norway . | |
| 118480 | 1/1927 | Switzerland | 280/615 |
| 138629 | 5/1930 | Switzerland | 280/615 |

*Primary Examiner*—Joseph F. Peters, Jr.
*Assistant Examiner*—Milton L. Smith

[57] ABSTRACT

A cross country ski binding having at least one upwardly extending member engaging in a corresponding recess in the toe portion of the sole of a ski shoe and a pair of conically divergent side members and an upper top restraint member to complete the location of the toe portion.

Actuating devices are provided for producing relative movement in the longitudinal direction of the binding between the upwardly extending member and the side and top restraint members so that the toe portion can first be inserted over the upwardly extending member and subsequently drawn into engagement with the side and top restraint members. The actuating devices include toggle lever devices, cam track and journal devices, and a gear wheel and gear track device.

2 Claims, 15 Drawing Figures

CROSS COUNTRY SKI BINDING

Figure 1:
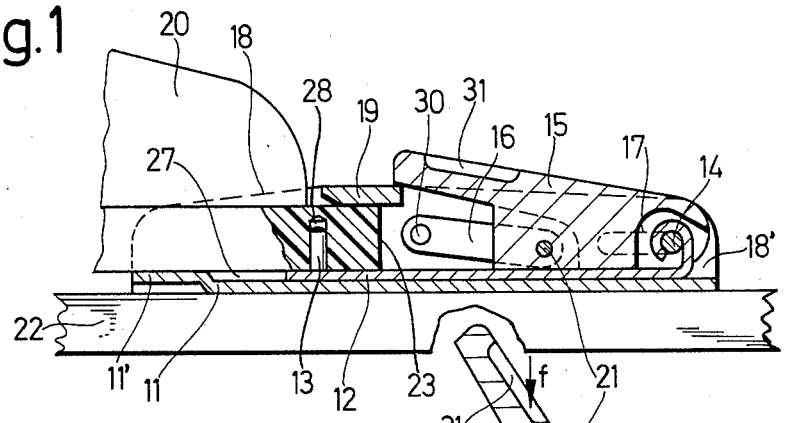

The invention relates to a cross country ski binding and has particular reference to a ski binding of the kind in which at least one vertically upstanding pin is adapted to engage in a corresponding recess in the toe portion of the sole of a ski shoe. In known cross country ski bindings of this kind it is conventional to additionally secure the toe portion of the ski shoe by two side members and a top restraint member. In such cross country ski bindings the vertically disposed pins which engage in matching bores or recesses in the toe portion of the ski shoe serve in particular to fix the ski shoe in the longitudinal direction of the ski while the side members are for sideways guidance of the ski shoe. The top restraint prevents the sole of the ski shoe for undesirably lifting from the pins. The entire arrangement is so laid out that the up and down rolling movement of the ski shoe relative to the ski during cross country skiing is restricted to the least possible extent.

A cross country ski binding of this type is e.g. described in DE-AS No. 16 03 004. In this known arrangement the top restraint comprises a wire loop which is pivotable downwardly onto the sole of the ski shoe and which can accordingly only exert a downwardly directed clamping force on the sole of the ski shoe. As on the other hand the relative position of the pins and the side members is fixed the danger exists that undesired play is present between the side surfaces of the sole of the ski shoe and the side members or that the sole of the ski shoe will be jammed between the side members. This state of affairs can be tracted back to the fact that the exterior dimensions of the sole of the ski shoe and of the binding which are intended to be matched one to the other are subject to certain tolerances. These tolerances can for example be attributed to the fact that the shoes and bindings are in general produced by various different manufactures. The effects of wear on the ski shoe can, however, also lead to play between the binding and the sole of the ski shoe.

A principal object of the present invention is thus to provide a cross country ski binding of the kind previously named which while retaining the proven principle of the vertically disposed location member engaging into the underside of the sole of the ski shoe, ensures that the ski shoe has an exact location in the binding and is located therein substantially without play.

According to the present invention there is provided a cross country ski binding comprising at least one vertically disposed member for engagement in a corresponding recess in the sole of a ski shoe and two side members and a top restraint member adapted to locate the sides and top respectively of the toe portion of a ski shoe engaged in an operational position in the binding, there being further provided means for producing relative movement in the longitudinal direction of the binding between, on the one hand said at least one vertically disposed member and, on the other hand said side members and said top restraint member from a first position in which a ski shoe can be engaged over the said at least one vertically disposed member to said operational position.

Thus in accordance with the invention the side members and the ski shoe placed over the vertically disposed member or members are displaced relative to one another in such a fashion that the amount of the displacement takes into account the possible tolerances between the sole of the ski shoe and the binding and correspondingly obviates the effects of these tolerances. As the top restraint member is also displaceable together with the side members relative to the vertically disposed member the need to especially engage the top restraint from above onto the sole of the ski shoe is avoided. The exact location of the sole of the ski shoe between the side members and beneath the top restraint member is achieved in a single operation, namely by producing the relative displacement taught by the present invention. The engagement of the tip of the sole of the ski shoe beneath the top restraint can be made easier by making the aperture defined by the top restraint for the entry of the sole of the ski shoe funnel-shaped or by providing a chamfer or the like at the entry side in order to ease the introduction of the ski shoe into the binding.

The thought underlying the present invention can be used for cross country ski bindings in which the side members and likewise the top restraint are fixed relative to the ski by providing the vertically disposed member or members on a plate adjustable in the longitudinal direction of the ski between the first and the operational positions. The ski shoe is thus drawn via the plate and the vertically disposed pins against the side members and beneath the top restraint member. In this embodiment the forward end of the plate is usefully connected to an adjusting mechanism fixedly located on the ski.

The invention can, however, also be used in connection with a cross country ski binding in which the vertically disposed member or the pins are fixed to the ski by arranging for the side members and the top restraint to be jointly displaceably guided and adjustable between the previously defined first and operational positions. In this advantageous embodiment the elements which locate the ski shoe from the sides and from above are moved over the toe portion of the ski shoe which is fixed relative to the ski via the pins. An expecially practical embodiment features an arrangement in which the side members and the top restraint member are connected to at least one plate which is displaceably guided in the longitudinal direction of the ski beneath a base plate fixed to the ski. It is especially advantageous if the side members and the top restraint member have a certain amount of sideways play relative to the vertically disposed pins within the scope of the tolerances that are to be expected, so that a certain degree of self-centering of the sole of the ski shoe within the side members is possible. Correspondingly, in an embodiment in which the vertically disposed pins are adjustable in the longitudinal direction of the ski the pins should be allowed the opportunity for sideways movement to assist in self-centering.

In the last named embodiment it is preferably arranged for the side members and the top restraint to be connected to an adjusting mechanism which is fixedly supported on the ski.

The adjustment mechanism can e.g. be a toggle lever device, a cooperating journal and cam track device or a cooperating gear wheel and gear track arrangement.

Figure 2:
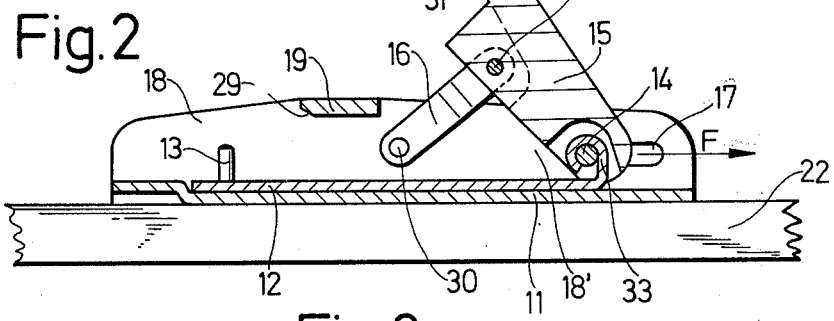
Figure 3:
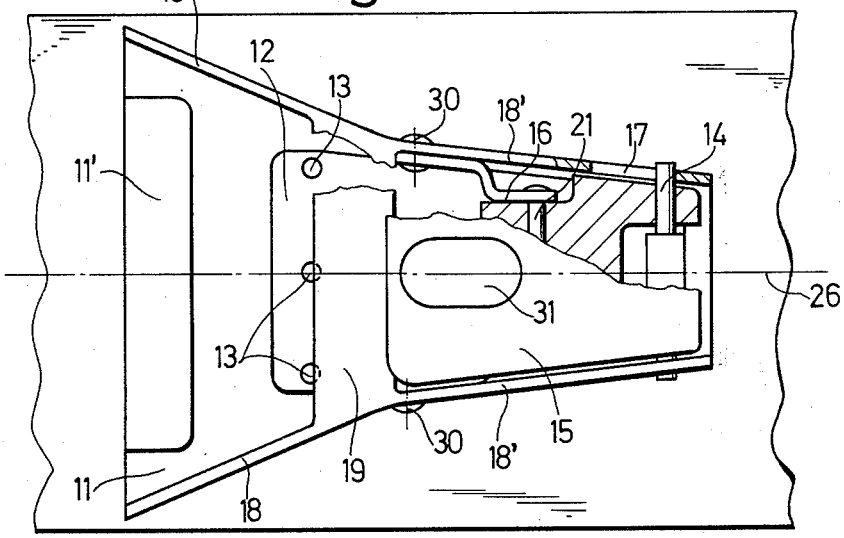
Figure 4:
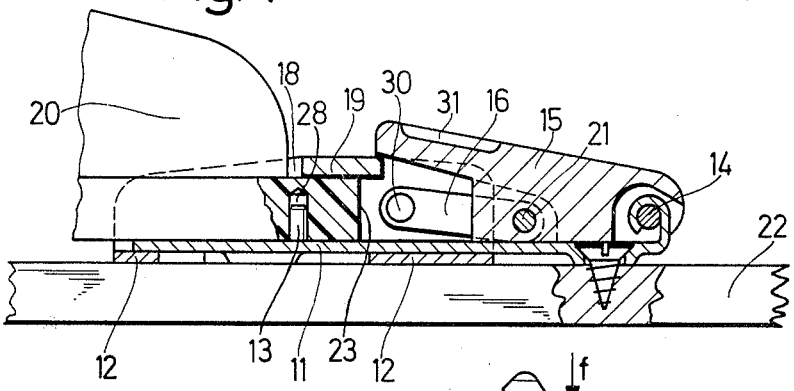
Figure 5:
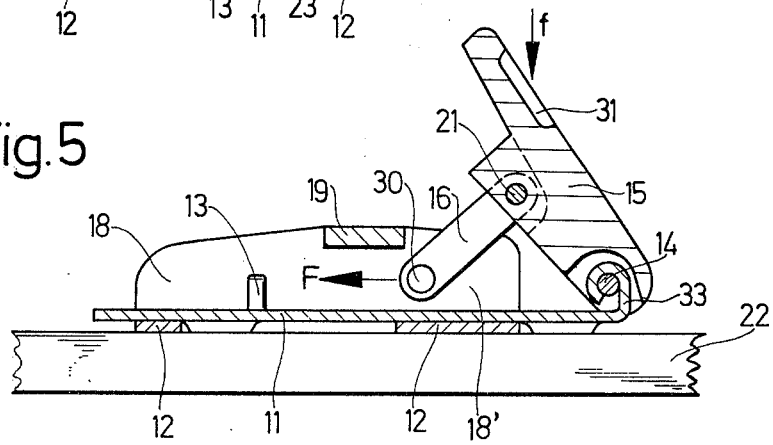
Figure 6:
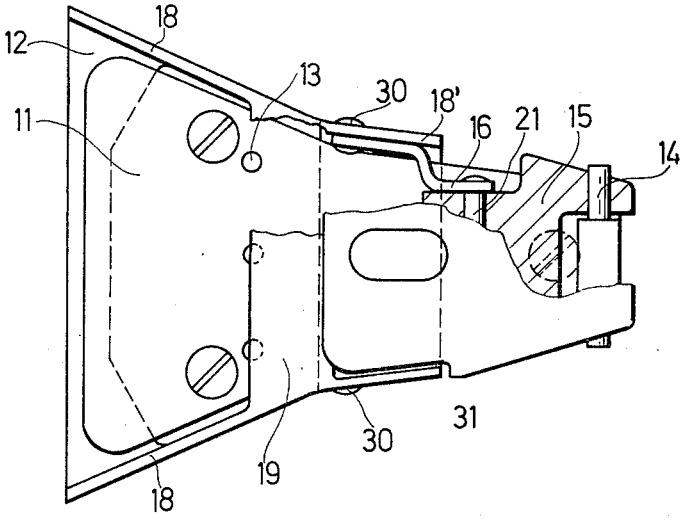
Figure 7:
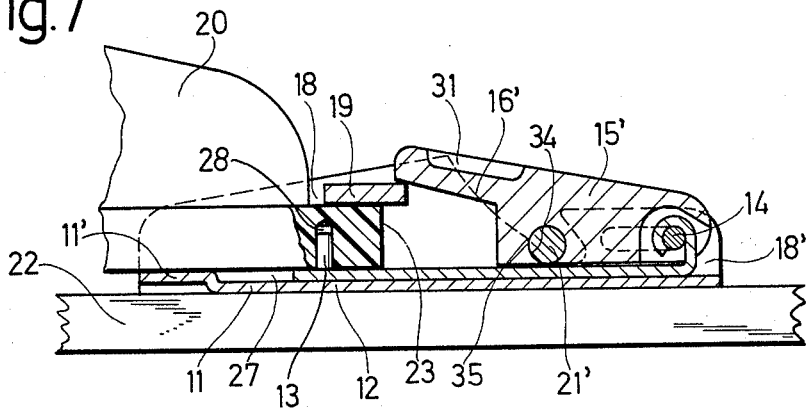
Figure 8:
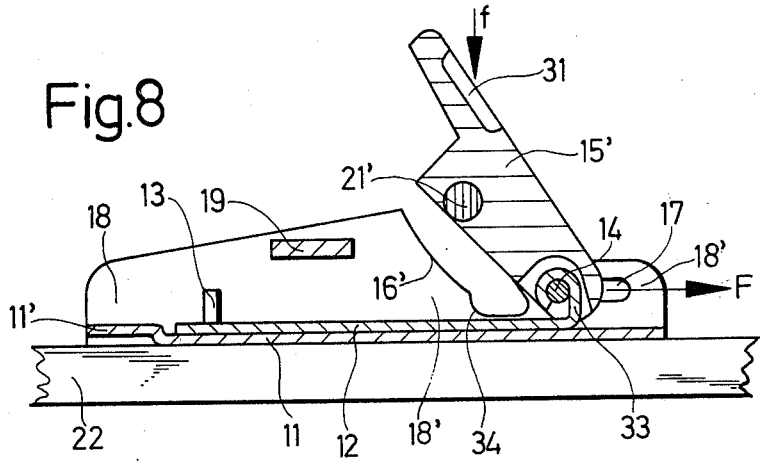
Figure 9:
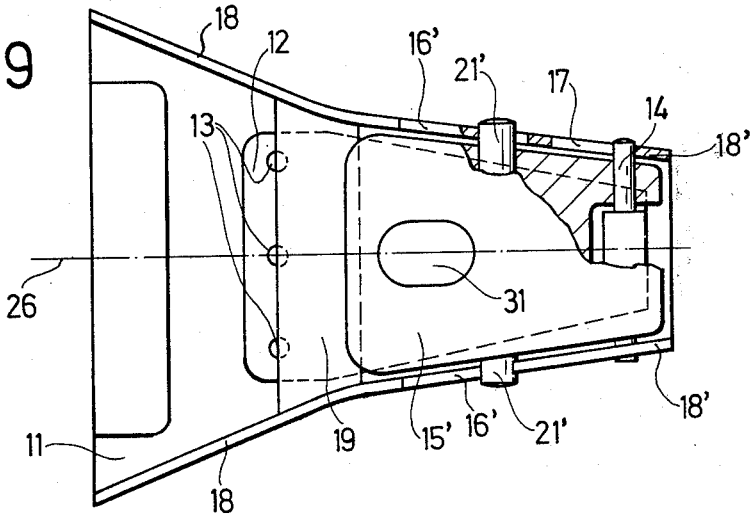
Figure 10:
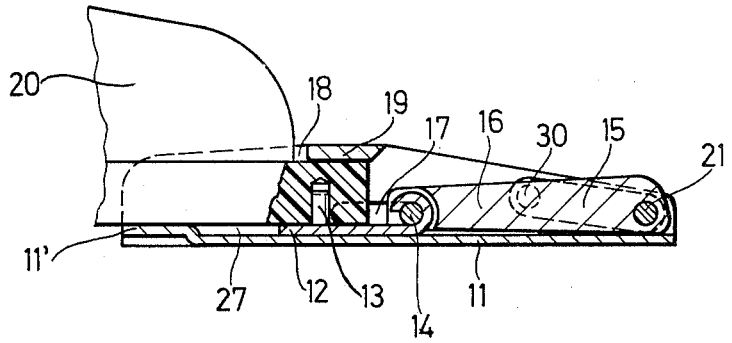
Figure 11:
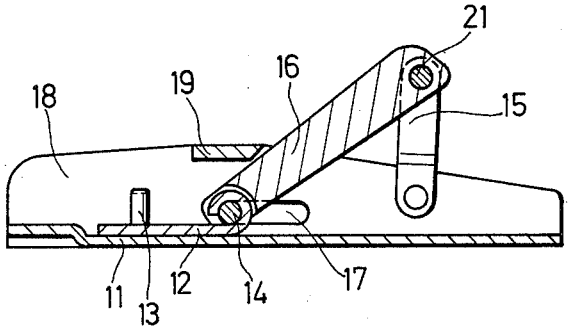
Figure 12:
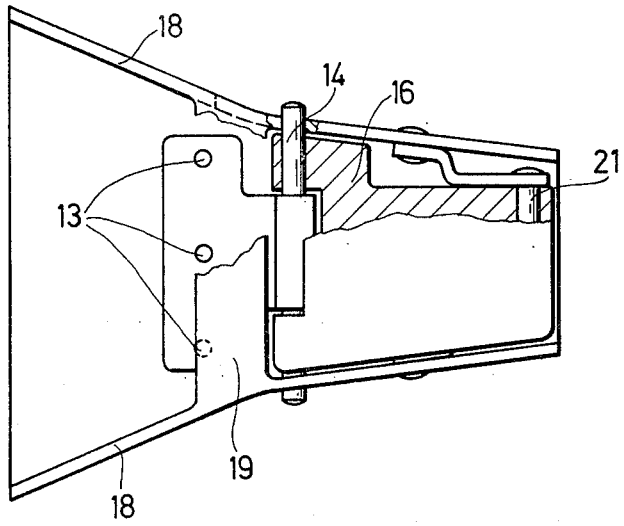
Figure 13:
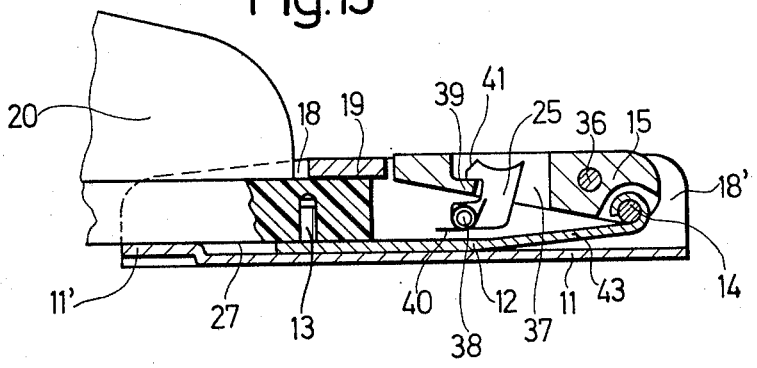
Figure 14:
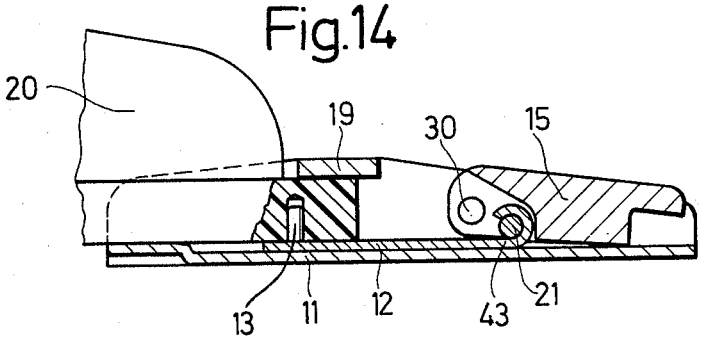
Figure 15:
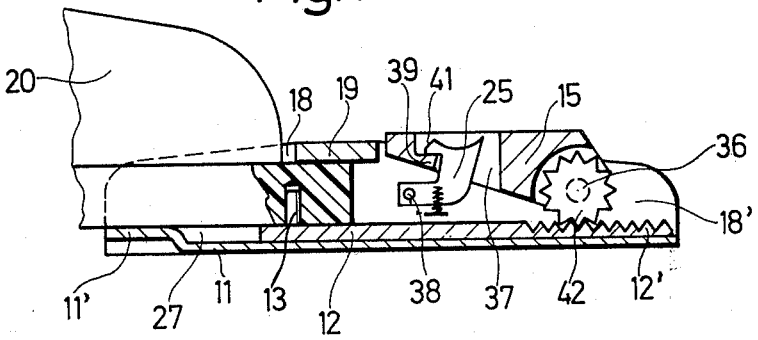

The invention will now be more particularly described by way of example only with reference to the following drawings which show:

FIG. 1 a partially sectioned side view of a first embodiment of a cross country ski binding in accordance with the present teaching and showing a ski shoe in the engaged operational position, FIG. 2 a view similar to FIG. 1 with the binding in its first open position without an engaged ski shoe, FIG. 3 a plan view of the binding of FIG. 1 without an engaged ski shoe, FIG. 4 a view similar to FIG. 1 of a further advantageous embodiment, FIG. 5 a view similar to FIG. 2 of the exemplary embodiment of FIG. 4, FIG. 6 a plan view similar to FIG. 3 of the exemplary embodiment of FIGS. 4 and 5, FIG. 7 a side view similar to that of FIGS. 1 and 4 of a further advantageous embodiment, FIG. 8 a view similar to the views of FIGS. 2 and 5 of the embodiment of FIG. 7, FIG. 9 a plan view similar to the views of FIGS. 3 and 6 of the exemplary embodiment of FIGS. 7 and 8, FIG. 10 a side view similar to that of FIGS. 1, 4 and 7 of an alternative preferred embodiment, FIG. 11 a side view similar to that of FIGS. 2, 5 and 8 of the exemplary embodiment of FIG. 10, FIG. 12 a plan view similar to that of FIGS. 3, 6 and 9 of the exemplary embodiment of FIGS. 10 and 11, FIG. 13 a side view similar to that of FIGS. 1, 4, 7 and 10 of an additional advantageous embodiment of a cross country skin binding in accordance with the present teaching, FIG. 14 a side view similar to that of FIG. 13 of a further embodiment and FIG. 15 a partly sectioned side view of another alternative embodiment.

In the following description the same reference numerals are used in all figures for corresponding or like parts.

Referring firstly to FIGS. 1 to 3 there is illustrated a cross country ski binding attached by a base plate 11 to a section of a ski 22. The ski binding, as will be later explained in more detail, basically comprises a positioning device, such as three vertically disposed pins which engage in corresponding recesses 28 in the toe portion of the sole 23 of the ski shoe 20. In the operative position shown in FIG. 1 the ski shoe is additionally located by two side members 18 and by a top restraint member or upper wall 19 of a housing part of the binding which fit around the toe portion of the sole of the ski shoe. An adjusting or actuation mechanism 15 allows the vertically upstanding pins to be displaced axially relative to the side members 18 and the top restraint 19 so that, in a first position illustrated in FIG. 2, the toe of the ski shoe can be inserted without difficulty over the pins 13 and so that, on adjustment of the adjusting mechanism, relative movement is produced between the pins 13 on the one hand and the side members 18 and the top restraint member 19 on the other hand. This movement in the ski shoe being located in the operative position shown in FIG. 1.

The mechanical arrangement will now be described in more detail. The base plate 11, as can be seen from FIG. 3, diverges rearwardly at first at a narrow angle and then at a more pronounced angle which corresponds to the wedge angle required for accommodating the toe portion of the sole of the ski shoe. The edges of the base plate 11 extend vertically upwardly so that, at the rear portion of the binding, they form the side members 18 and so that, at the forward portion, they define side plates 18′ which are used to support the adjusting mechanism 15. At its rearmost end the base plate 11 has an upwardly directed projection 11′ which forms a support surface for the sole of the ski shoe and which defines together with the remainder of the base plate 11 a recess 27 with a flat bottom surface in which is located an axially slidable plate 12. In FIGS. 1 and 3 the axially slidable plate 12 which carries the three vertically disposed pins 13 is shown in its forward position while in FIG. 2 it is shown in the rearmost position that it occupies during insertion of the ski shoe into the binding.

The slidable plate 12 is arranged to have a certain amount of play relative to the base plate 11 in the transverse direction and is preferably so guided that it cannot lift out of the recess 27.

The three vertically disposed pins 13 are arranged on the slidable plate 12 transversely of the ski so that the middle one is located on the central longitudinal axis 26 of the ski and the two pins at the sides are arranged one to either side of this axis as far away from the central pin as is conveniently possible. As can be seen in FIG. 1 the pins are arranged to engage suitable recesses 28 in the region of the sole of the ski shoe that projects forwardly from the shoe upper 20.

At their forward ends the upper edges of the side members 18 are connected together by a top restraint member or upper wall 19 which is formed as a flat plate and which can have a chamfer 29 (FIG. 2) at its edge facing the ski shoe 20 to simplify the insertion of the ski shoe into the binding.

The slidable plate 12 has a range of movement relative to the base plate 11 from the operative position shown in FIG. 1 in which the pins 13 are approximately aligned with the rear edge of the top restraint member 19 to the first position shown in FIG. 2 in which the pins have a considerable spacing from the rear edge of the top restraint member 19. The displacement of the slidable plate between these two positions is carried out by means of a toggle lever device which has two toggle lever links 16 disposed one to either side of the binding and pivotally connected to the side plates 18′ about transverse axes 30 and an actuating toggle lever 15. The lever 15 is connected via the toggle lever pivot joint 21 to the toggle lever links 16 and is connected to the side plates 18 via a transverse pin 14. The transverse pin 14 extends sideways through longitudinal slots 17 in the side plates 18′. The actuating toggle lever 15 has a depression 31 in its top surface so that it can be closed by inserting the tip of a ski pole or the like.

The pin 14 is additionally connected with an upwardly curved and, as can be seen in the drawing, rolled part 33 of the slidable plate 12 so that the slidable plate 12 must follow the movement in the longitudinal direction of the ski carried out by the transverse pin 14 on engagement, or disengagement, of the toggle lever mechanism.

The three pivot joints 14, 21 and 30 are, in accordance with the principles of a toggle lever (or overcenter linkage) so arranged that depression of the actuating toggle lever 15, when the binding is in the first open position of FIG. 2, results in forward displacement of the transverse bolt 14 and thus of the slidable plate 12. Shortly before the forward ends of the longitudinal slots 17 are reached by the transverse pin 14 the joint 21 passes downwardly through the imaginary line connecting the pivotal joints 14 and 30 so that the over-center point of the toggle linkage is exceeded and opening of the binding on its own accord is impossible.

The manner of use of the cross country ski binding of FIGS. 1 to 3 is as follows:

In order to step into the binding the actuating toggle lever 15 is moved into the position shown in FIG. 2. The slidable plate 12 and the vertically disposed pins 13 are thus located at their rearmost position.

The spacing of the pins 13 from the rear edge of the top restraint member 19 is now sufficiently large that the recesses 28 in the underside of the sole of the ski shoe 20 can be engaged over the pins 13 from above without effort and without the forward edge 23 of the sole of the ski shoe colliding with the top restraint 19.

After the shoe has been placed on the pins 13 the actuating toggle lever 15 is, e.g. by use of the tip of the ski pole, pressed downwardly in the direction of the arrow f of FIG. 2. Because of the manner of operation of the toggle lever device the transverse pin 14 is displaced forwardly inside the longitudinal slots 17 so that, via the upwardly turned edge 33 the slidable plate 12 and thus the pins 13 are moved forwardly in the direction of arrow F. Correspondingly, the ski shoe 20 is drawn forwardly with the slidable plate 12 so that the forward portion of the sole of the ski shoe 20 is pulled under the top restraint 19 which is arranged above the slidable plate 12 by a vertical distance such that the sole of the ski shoe fits without play between the plate 12 and the top restraint 19.

As soon as the joint 21 has passed the neutral point of the toggle lever linkage and reached the position of FIG. 1 the ski shoe 20 is exactly located in the binding as the side surfaces of the sole of the shoe 20 now securely abut the side members 18. The elasticity of the sole of the ski shoe allows certain tolerances to be compensated without further ado. In any case, even when the sides of the ski shoe would, in a conventional type of binding, tend to jam between the side members the skier equipped with the present type of ski binding experiences no difficulty during inserting his ski shoe into the binding as, when the binding is in the first FIG. 2 position there will be a significant clearance between the sole of the ski shoe and the side members 18. In contrast it is to be expected that too narrow a fit between the sole of a ski shoe and the side members in the known prior art cross country ski binding would cause significant difficulties in inserting the ski shoe into the binding.

The arrangement of the actuating toggle lever 15 of FIG. 1 is such that after the toggle lever joint 21 has passed through the neutral position its underside comes to rest in abutment against either the slidable plate 12 or the base plate 11 so that further downward movement of the toggle lever beyond the position of FIG. 1 is precluded.

Removal of the ski shoe from the binding takes place in reversed sequence in which first of all the actuating toggle lever 15 is pivoted upwardly so that it reaches the position of FIG. 2 and the ski shoe can without effort be withdrawn upwardly from the binding.

FIGS. 4 to 6 show an alternative embodiment in which the pins 13 are fixedly located on the ski by attaching them to the base plate 11 which is itself fixedly screwed to the ski. The side members 18 and the top restraint member 19 which connects them together at their forward ends are now made displaceable from the first position of FIG. 5 towards the ski shoe along the ski 22.

This displaceability is ensured in practice by arranging that the base plate 11 is spaced at other than its points of attachment to the ski by a trivial clearance from the top surface of the ski 22 so that the plate parts 12 joining the lower edges of the side members 18 can extend through the space between the base plate 11 and the top surface of the ski 22. The dimensions are so chosen that the slidable plate parts 12 are displaceably guided between the base plate 11 and the top surface of the ski in the longitudinal direction of the ski. The arrangement is in other respects such that the unit formed by the side members 18, the top restraint member 19 and the slidable plate parts 12 is allowed to have a certain amount of sideways play relative to the base plate 11. The side plates 18' which carry the adjusting mechanism are also made displaceable in the longitudinal direction of the ski with the side members 18.

As can be seen in FIGS. 4 to 6 the forward end of the actuating toggle lever 15 is pivotally connected about the transverse pin 14 with the upwardly bent part 33 of the fixed base plate 11. The toggle lever links 16 extend from the toggle lever joint 21 to the further toggle lever pivot axis 30 which is located at the side plates 18'.

The relative position between the top restraint member 19 and the pins 13 in the open position of the binding as shown in FIG. 5 is the same as for the embodiment of FIG. 2. The ski shoe can thus be placed onto the pins 13 in a corresponding manner.

On depressing the actuating toggle lever 15 in the direction of the arrow f of FIG. 5 the base plate 11 remains stationary because of its fastening to the ski while the side plates 18', the side members 18, the top restraint member 19 and the slidable plate part 12 are displaced rearwardly towards the ski shoe 20 in the direction of the arrow F'. This movement is caused by the movement of the pivot 30 and results in the top restraint member 19 being pushed over the part of the sole of the ski shoe which projects forwardly beyond the shoe upper into the position shown in FIG. 4. The toggle link pivot simultaneously moves over the neutral point so that the ski shoe 20 is securely fixed in the binding in the position which can be seen from FIG. 4.

The embodiment shown in FIGS. 7 to 9 corresponds extensively with the embodiment of FIGS. 1 to 3 with the exception that a securing device comprising a latch journal 21' and a cam track 16' are used for the adjusting mechanism in place of a toggle linkage device. An actuating lever 15' is provided which is attached to the side plates 18' via a transverse pin 14 which as can be seen in FIGS. 7 to 9 is pivotally and axially displaceably journalled within longitudinally extending slots in the side plates 18'. At its rearward end, i.e. the end facing the ski shoe 20 the actuating lever 15' is provided with side projecting journals 21' which cooperate with the cam tracks 16' that are provided on the side plates 18'.

The manner of operation of the binding of FIGS. 7 to 9 is as follows:

With the binding in the position shown in FIG. 8 a ski shoe is placed on the pins 13 exactly in the manner of the exemplary embodiment of FIG. 2. If now, by exerting a force in the direction of the arrow f of FIG. 8, the lever 15' is pivoted downwardly then the journals 21 come into engagement with the cam tracks 16'. As a result of the inclined forwardly reducing run of the cam tracks 16' further depression of the lever 15' results in the transverse pin 14 being displaced forwardly along the longitudinal slots 17 so that the slidable plate 12 and thus the pins 13 are also slid forwardly together with the transverse pin 14. At the lower ends of the cam tracks 16' there are provided latching recesses 34 in which the latching journals 21' can snap into latching engagement after the apex points 35 have been exceeded. The location of the latching recesses and their shape is chosen so that after reaching the latched position the actuating lever 15' cannot release of its own accord. For the purposes of the present invention it is thus essential that the cam tracks 16 have a curved surface which enables the slidable plate 12 to be displaced forwardly and latching recesses 34 at their forward ends which define the forward operational closed position of the binding.

Opening of the binding is simply achieved by lifting the actuating lever 15' which causes the journals 21' to spring upwardly out of the latching recesses 34 over the apex point 35 of the cam track.

To ensure the latched position of the actuating lever is stable the recesses are disposed beneath the imaginary line connecting the resultant force on the ski shoe with the pin 14.

FIGS. 10 to 12 likewise show an exemplary embodiment similar to that of FIGS. 1 to 3, however, instead of an extended toggle lever device a toggle lever device is used which has overlapping toggle levers 15, 16. The toggle lever pivot 21 thus lies in this embodiment in the closed position of FIG. 10 in front of the two other toggle lever axes 14 and 30. The manner of operation is, however, completely analogous to that of the exemplary embodiment of FIGS. 1 to 3.

While the exemplary embodiments of FIGS. 1 to 12 operate on the principle of spring retention of the actuating lever 15 in the closed position, FIGS. 13 and 15 show exemplary embodiments in which the binding is locked into the closed position by a hooked latch 25.

In the embodiment of FIG. 13 the slidable plate 12 is pivotally connected to a two-armed actuating lever 15 itself pivotable about a transverse axis 36. The other arm of the actuating lever 15 has a recess 37 into which extends the latch hook 25, which is pivotable from below about a transverse axis 38. The latch hook 25 cooperates with an abutment 39 in such a fashion that the actuating lever 15 can only be opened from the closed position of FIG. 13 when the latch hook 25 has previously been pivoted forwardly out of the latching position. The pivotal movement of the latch hook 25 in the forward direction is made possible by making the recess 37 sufficiently wide in the forward direction.

A spring 40 prestresses the latch hook 25 into its latching position.

An inclined face 41 at the upper rear end of the hook 25 makes it possible for the latch hook 25 to snap of its own accord into the latching position on depression of the actuating lever 15 from the opened to the closed operational position of the binding.

In the exemplary embodiment of FIG. 15 the slidable plate 12 has a gear track 12' formed at its forward end and a gear wheel 42 arranged on the actuating lever 15 meshes with this gear track. The gear wheel 42 is arranged coaxially with the transverse pivot axis of the lever 15.

The latch hook 25 is pivotally connected to the side plates 18' of the binding, which are fixed to the ski in similar manner to the embodiment of FIG. 13, and extends upwardly through a correspondingly sized opening 37 in the actuating lever 15 so that the latch hook is accessible from above. This embodiment functions in a manner similar to the embodiment of FIG. 13. By pivoting the actuating lever 15 which is journalled in the side plates 18' upwardly the gear track and slidable plate 12' are displaced rearwardly in the longitudinal direction of the ski via the toothed wheel 42. These pins can thus be correspondingly displaced to the first open position or the closed operating position.

In the exemplary embodiment of FIG. 13 the slidable plate 12 must be made elastic at least in its forward region 43 so that the arcuate movement of the transverse pin 14 can be converted into linear movement of the slidable plate 12 without undue resistance. For these reasons the forward part 43 of the sliding plate 12 in FIG. 13 is shown spaced by a certain amount from the base plate 11.

The forward part 43 of the slidable plate 12 of the embodiment of FIG. 14 must also be correspondingly flexible. FIG. 14 once more shows a toggle lever adjustment device with overlapping toggle levers and the links for the toggle lever are formed by the flexible part 43 of the slidable plate 12. As in this embodiment the pivot axis 21 and forward end 43 of the slidable plate 12 have to move past the transverse pivot axis of the actuating toggle lever 15, the actuating toggle lever 15 is fastened to each of the side plates 18' by respective individual pivoted joints 30 which are aligned spaced apart to define the transverse pivot axis. The functioning of this embodiment is analogous to that of the previously given exemplary embodiments.

We claim:

1. A cross country ski binding for securing a ski shoe by a forward sole portion thereof to a ski, the binding comprising: a housing part adapted in an engaged position of the binding to locate said forward sole portion, a positioning device adapted to position said forward sole portion relative to said housing part, and including at least one generally vertically disposed member engageable in recess means in an underside of said forward sole portion, and an actuation mechanism adapted to effect relative movement between said positioning device and said housing part, wherein said housing part includes first and second rearwardly diverging side members, and upper wall means extending between said side members and cooperating therewith to define a chamber open to the rear of the binding, with the internal dimensions of said chamber being substantially equal to the dimensions of said forward sole portion, wherein said actuation mechanism includes a pivotable actuating lever, is mounted on the binding and is operable, on pivotal movement of said actuating lever, to effect relative movement of said positioning device and said housing part between a disengaged position, in which said at least one generally vertically disposed member is spaced longitudinally of the ski from said upper wall means so that said recess means in said ski shoe can be positioned over said at least one generally vertically disposed member, and an engaged position in which said at least one generally vertically disposed member is operative to retain said forward sole portion within said chamber in contact with said side members, and wherein said actuation mechanism is a toggle lever mechanism comprising first and second toggle lever links respectively pivotally connected by their one ends to said first and second side members, and at their other ends to a toggle lever, said toggle lever, which forms said actuating lever, being pivotally connected to a forward end of said positioning device via a transverse pin, said transverse pin being guided for sliding movement in longitudinal slots formed in said first and second side members.

2. A cross country ski binding for securing a ski shoe by a forward sole portion thereof to a ski, the binding comprising: a housing part adapted in an engaged position of the binding to locate said forward sole portion, a positioning device adapted to position said forward sole portion relative to said housing part, and including at least one generally vertically disposed member engageable in recess means in an underside of said forward sole portion, and an actuation mechanism adapted to effect relative movement between said positioning device and said housing part, wherein said housing part includes first and second rearwardly diverging side members, and upper wall means extending between said side members and cooperating therewith to define a chamber open to the rear of the binding, with the internal dimensions of said chamber being substantially equal to the dimensions of said forward sole portion, wherein said actuation mechanism includes a pivotable actuating lever, is mounted on the binding and is operable, on pivotal movement of said actuating lever, to effect relative movement of said positioning device and said housing part between a disengaged position, in which said at least one generally vertically disposed member is spaced longitudinally of the ski from said upper wall means so that said recess means in said ski shoe can be positioned over said at least one generally vertically disposed member, and an engaged position in which said at least one generally vertically disposed member is operative to retain said forward sole portion within said chamber in contact with said side members, and wherein said actuation mechanism is a toggle lever mechanism comprising first link means, first pivot means pivotally connecting said first link means to said side members, second link means, second pivot means pivotally connecting said second link means to said positioning device in front of said first pivot means, third pivot means pivotally connecting said first link means to said second link means at a position intermediate said first and second pivot means, and lever means defining said actuating lever for producing movement of said first and second link means about said first and second pivot means for effect said relative movement.

* * * * *